US007849926B2

(12) United States Patent
Inderberg

(10) Patent No.: US 7,849,926 B2
(45) Date of Patent: Dec. 14, 2010

(54) SAFETY JOINT

(75) Inventor: Olav Inderberg, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 319 days.

(21) Appl. No.: 11/663,186

(22) PCT Filed: Sep. 20, 2005

(86) PCT No.: PCT/NO2005/000346

§ 371 (c)(1),
(2), (4) Date: Dec. 19, 2007

(87) PCT Pub. No.: WO2006/033580

PCT Pub. Date: Mar. 30, 2006

(65) Prior Publication Data

US 2008/0105435 A1 May 8, 2008

(30) Foreign Application Priority Data

Sep. 20, 2004 (NO) ..... 20043933

(51) Int. Cl.
*E21B 29/12* (2006.01)

(52) U.S. Cl. ..... 166/363; 166/364; 166/361; 166/367; 137/68.14; 137/68.15

(58) Field of Classification Search ..... 166/363, 166/361, 367, 338, 359, 364, 345, 355; 251/1.1; 285/1, 2; 137/68.14, 68.15
See application file for complete search history.

(56) References Cited

U.S. PATENT DOCUMENTS 2,300,483 A * 11/1942 Berger et al. ..... 137/614.04
3,421,580 A 1/1969 Fowler et al.
3,861,463 A * 1/1975 Crowe ..... 166/367
3,913,603 A * 10/1975 Torres ..... 137/68.15
3,921,656 A * 11/1975 Meisenheimer et al. .. 137/68.15
4,009,753 A * 3/1977 McGill et al. ..... 166/55.1
4,051,894 A * 10/1977 Goad ..... 166/73
4,077,472 A * 3/1978 Gano ..... 166/382
4,090,524 A * 5/1978 Allread et al. ..... 137/68.15
4,117,287 A 9/1978 Walker et al.
4,139,058 A * 2/1979 Gano ..... 166/360
4,253,525 A 3/1981 Young
4,328,822 A * 5/1982 Wilhelm ..... 137/68.15
4,351,351 A * 9/1982 Flory et al. ..... 137/68.14
4,361,165 A * 11/1982 Flory ..... 137/69
4,576,234 A * 3/1986 Upchurch ..... 166/319
4,653,776 A * 3/1987 Borg ..... 285/2
5,305,776 A * 4/1994 Romano ..... 137/68.14
5,699,823 A * 12/1997 Thomson ..... 137/68.15

(Continued)

FOREIGN PATENT DOCUMENTS

GB 2 344 391 A 6/2000

(Continued)

*Primary Examiner*—Thomas A Beach
*Assistant Examiner*—Matthew R Buck

(57) ABSTRACT

The invention relates to a safety joint (10; 100; 200) for a riser consisting of two telescoping parts that are arranged to break in the event of a predetermined axial tension load. The joint also comprises means (21, 41; 121, 141; 221, 241) for closing the passage in the joint in the event of fracture where the means are activated by means of the forces generated during the separation.

17 Claims, 4 Drawing Sheets

U.S. PATENT DOCUMENTS

Figure 1:
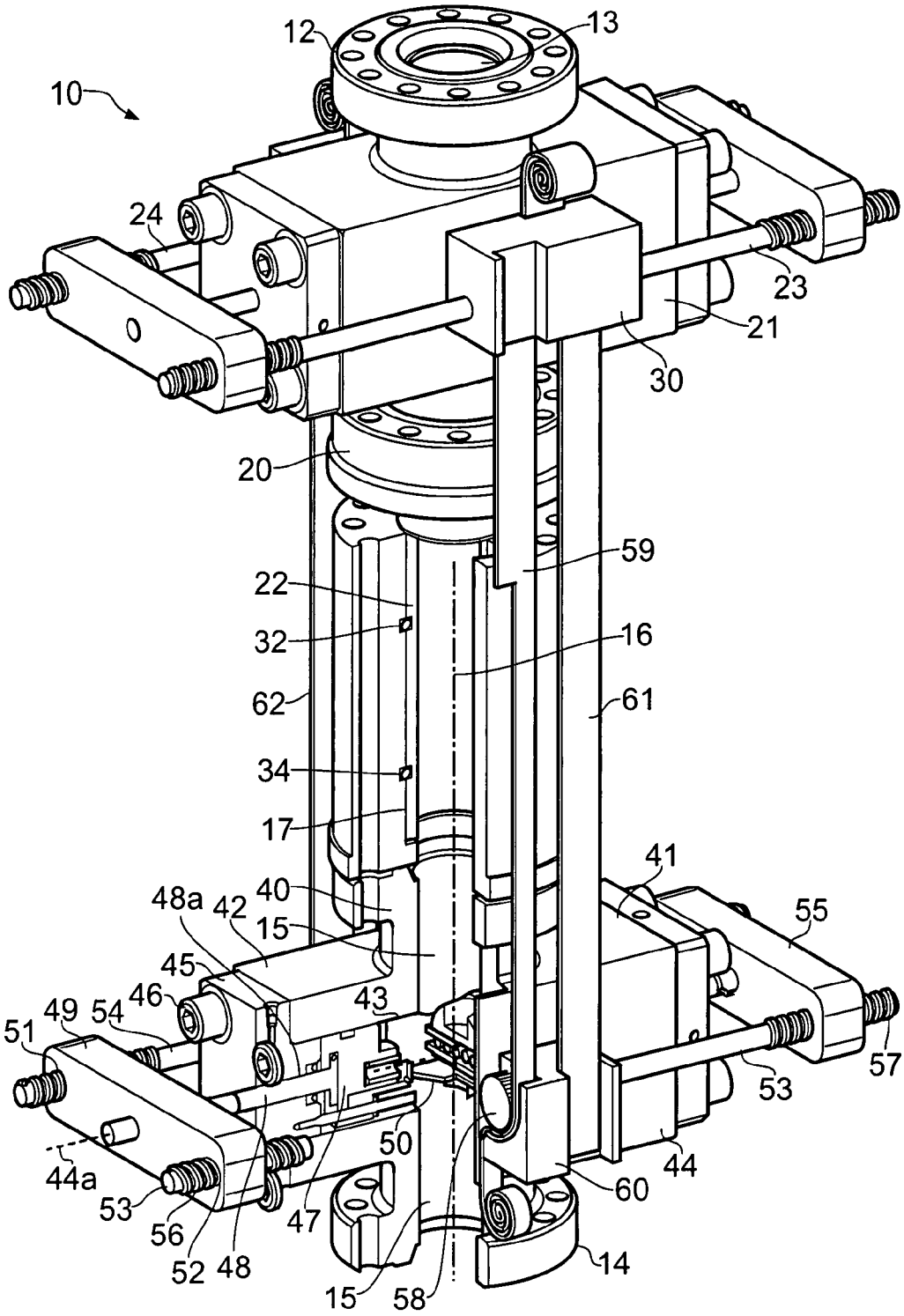

| | | | | |
|---|---|---|---|---|
| 6,152,229 | A * | 11/2000 | Jennings | 166/321 |
| 6,557,637 | B1 * | 5/2003 | Dore et al. | 166/338 |
| 7,234,527 | B2 * | 6/2007 | Nivens et al. | 166/340 |
| 7,240,734 | B2 * | 7/2007 | Nivens et al. | 166/339 |

FOREIGN PATENT DOCUMENTS

| | | | |
|---|---|---|---|
| GB | 2 352 494 | A | 1/2001 |
| WO | WO 01/86110 | A1 | 11/2001 |
| WO | WO 2004/055316 | A2 | 7/2004 |
| WO | WO 2004/113158 | A2 | 12/2004 |

* cited by examiner

SAFETY JOINT

BACKGROUND OF THE INVENTION

The invention relates to a joint device, especially a safety joint for a riser extending between a vessel and a subsea installation, which joint comprises two telescoping parts, each defining a fluid channel and interconnected by means that are arranged to be broken at a predetermined axial load.

The invention also comprises a method.

Operations in subsea wells are normally conducted by establishing a closed column connecting the well with a vessel on the surface, thus providing safe access to the well. A column of this kind is usually called a riser or riser system and includes not only the actual pipe but also several other devices which in addition to the actual pipe are necessary for safe access to the well. All operations down in the well are conducted through the riser, which forms a barrier between well fluids and the surrounding seawater. Work is carried out on a "live" well, i.e. the well is open all the way up to the vessel with well fluids at a pressure corresponding to the formation pressure. The riser therefore must be designed to be able to withstand high well pressure. Otherwise an uncontrolled blow-out may cause the riser to be filled with gas from the well, with the result that the pressure inside the riser sinks to almost zero.

The riser system normally comprises a lower riser package LRP with a number of valves for closing down the well, thereby functionally corresponding to a blow-out preventer (BOP). There are also provided an emergency quick disconnect package (EQDP) and a stress joint. At the upper end of the riser, i.e. in the vessel, there is usually provided a surface BOP. In addition the riser may be equipped with a bending member and buoyancy elements, together with any other devices required for operations on a subsea well.

When operations have to be performed on wells located at great depths, a vessel is employed which is kept in the correct position by means of propellers and/or thrusters. Such vessels are called dynamically positioned (DP) vessels. These vessels are highly dependent on all systems working satisfactorily and normal practice requires them to be equipped with several systems as security against the vessel drifting out of position.

During operations from a dynamically positioned vessel, situations may arise where it is necessary to leave the position above the well quickly. This may be controlled, such as when a warning of deteriorating weather conditions makes it necessary to evacuate the position, or uncontrolled, where some of the systems fail and the vessel begins to drift out of position. Such a situation may also occur in the event of sudden bad weather, but particularly in situations where the vessel's systems are not capable of keeping the vessel in the correct position above the well. The consequences of such a situation may be that the heave compensation system touches the bottom or that the riser assumes an unacceptable angle resulting in loading that exceeds the riser's design load.

Such situations can result in fracture of the riser. In situations of this kind it is important to control the fracture, i.e. to ensure that it occurs at a location where the well's barriers remain intact.

Fracture of the riser may result in damage to the vessel and constitute a risk to personnel as well as causing environmental damage, i.e. spillage of hydrocarbons, hydraulic fluid or the like. This may occur on account of the energy in the tensioned riser and the content of the riser. A complicating factor will be present if the riser has an internal pressure with an unstabilised fluid or a mixture of gas and fluid. The fluid that then flows out of the lower end of the riser will give rise to an upwardly-directed force that attempts to push the riser up in the rig towards the heave compensation, thereby making the situation more unstable. The most extreme consequence is that the riser may be pushed upwards with such force that serious damage is done to the equipment in the vessel and it may even be wrecked. A situation of this kind may also lead to loss of human life.

It is previously known to equip pipes with safety joints that are broken if the pipe is subjected to tension exceeding a predetermined value. This comprises shear pins that are broken when there is tension in the pipe. The position of the fracture can thereby be controlled and it can be located in an area that results in the least possible damage to equipment. However, since the riser has a high internal pressure, dangerous situations may still arise as mentioned above.

It is also previously known to arrange valves in a safety joint in such a way that the fluid channel close when the joint are broken. In WO 2004/055316 are shown and described a working string extending through a riser and down in a well. The working string is arranged to be broken at a predetermined upwardly directed load and comprise valves for closing fluid channels over and under the separation joint respectively. The valves are held open by means of hydraulic pressure but are equipped with pull-back springs which actuate the valve to closing when the hydraulic pressure disappears. By rupture the hydraulic supply pipe will also break in such a way that the pressure in the pipe drops. The disadvantage with this embodiment is that it must be arranged hydraulic connection lines from surface and that a hydraulic pressure must be maintained during the work operations. If this pressure for some reason should be lost, e.g. by failure in the system, the valves will close unnecessary and could cause disturbance or even dangerous situations.

One other example of the prior art is WO 01/86110 which concern a device for disconnecting an upper part of a riser from a lower part which are connected with, or cemented, in a pipe at seabed. The procedure and mechanism for separating the two parts from each other is relative complicated and result in some operational steps which have to be done in correct sequence. The most important moment here is that in order to disconnect the two parts, the tension in the upper part of the riser must be reduced first (or even be compressed (see col. 30, first section)) in order to release the locking mechanisms and afterwards it is put under tension again to pull the upper part of the riser up from the lower part. Thus one has to undertake an active action in order to release the locking mechanism before the disconnection. The disadvantage with this is that in a emergency situation, where the platform drifting off, there can be a situation where it will be impossible to reduce the tension in the riser, because there will simply not be time nor room to carry out a procedure like this. It is self-evident that in a case like this the tension load will increase, and if there are no weakening devices present the riser will actually break.

SUMMARY OF THE INVENTION

The invention attempts to redress this problem by providing a riser joint with the features specified in claim 1.

The means advantageously comprise shear elements for cutting a pipe, wire or cable located in the passage.

The said means are activated by means of the force to which the riser is subjected during the separation, where a transmission arranged in one part of the joint is employed to activate the closing means in the other part.

Figure 2:
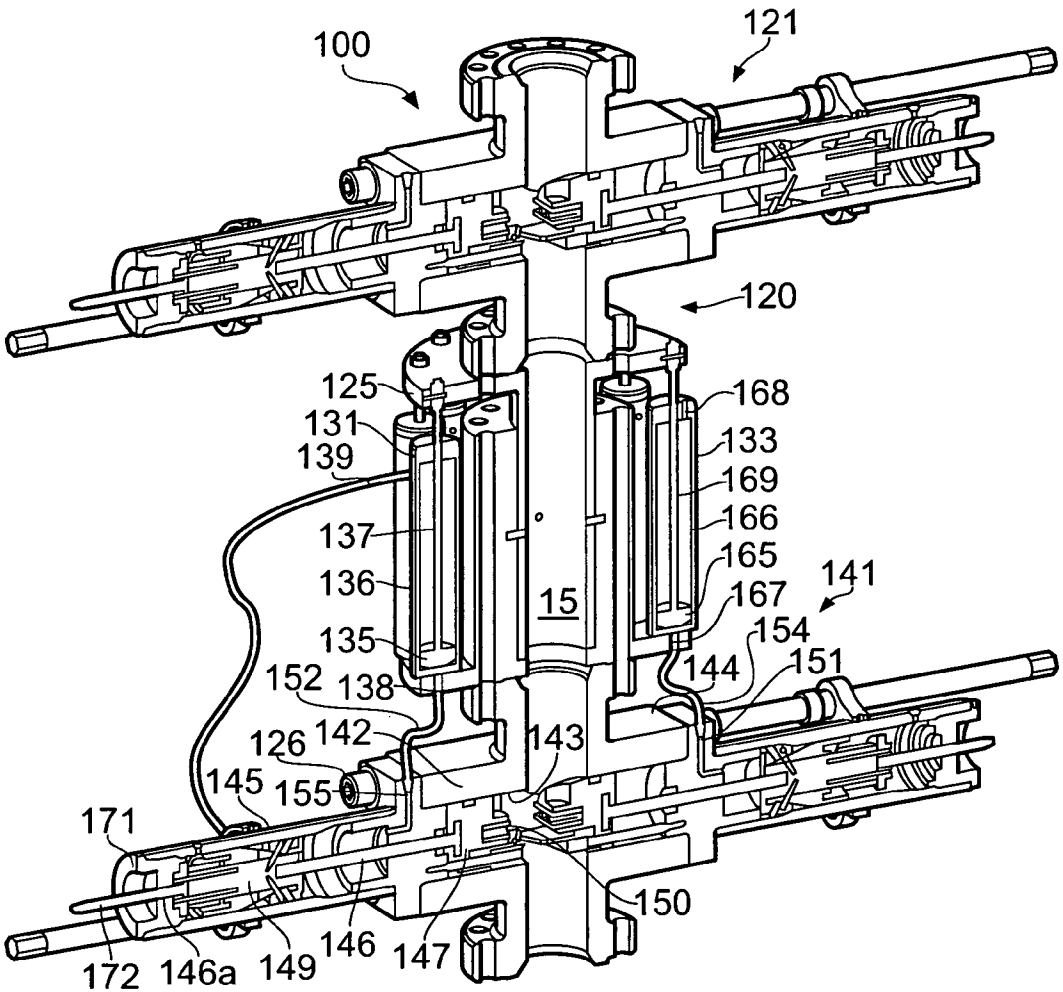
Figure 3:
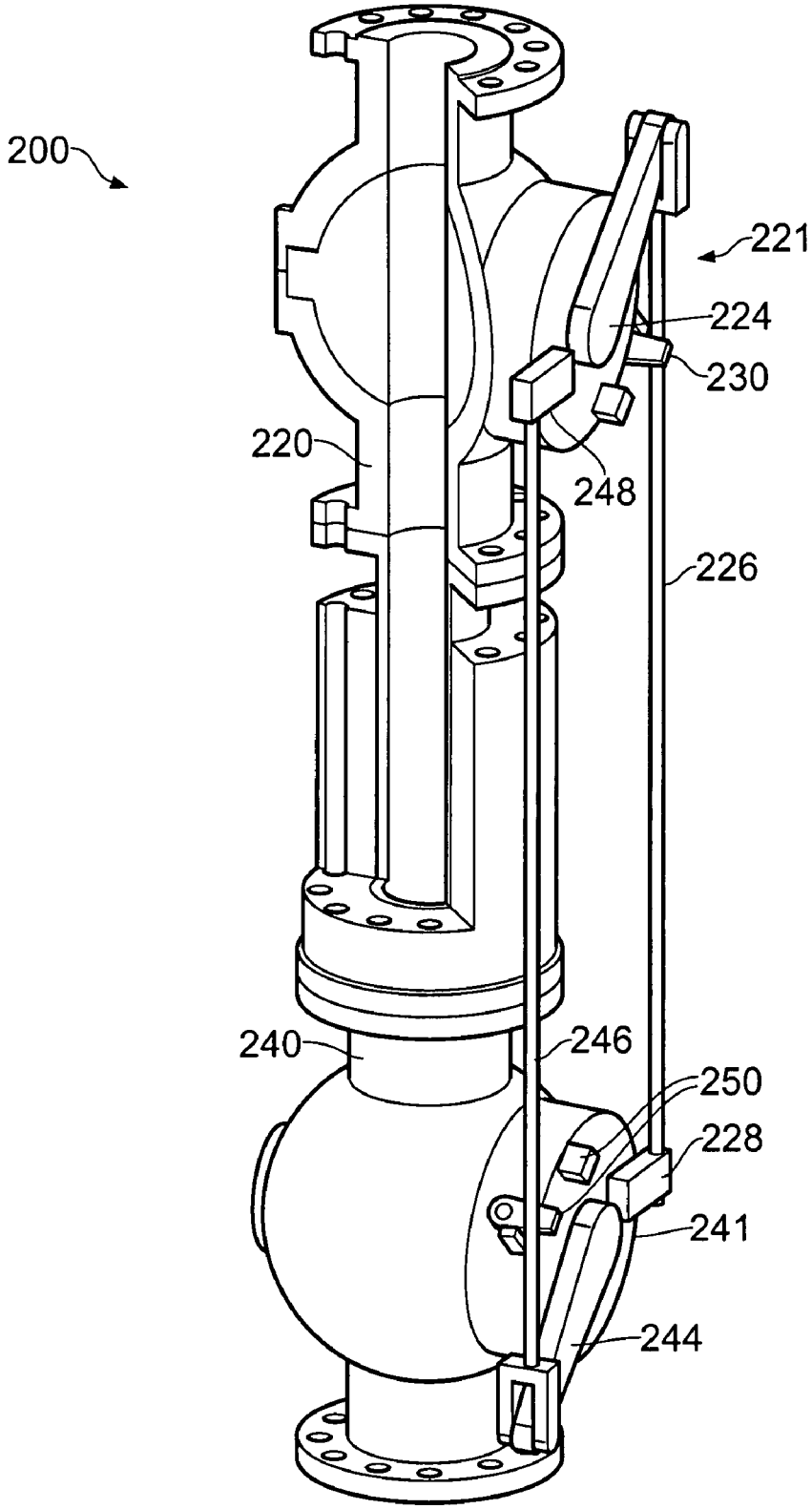
Figure 4:
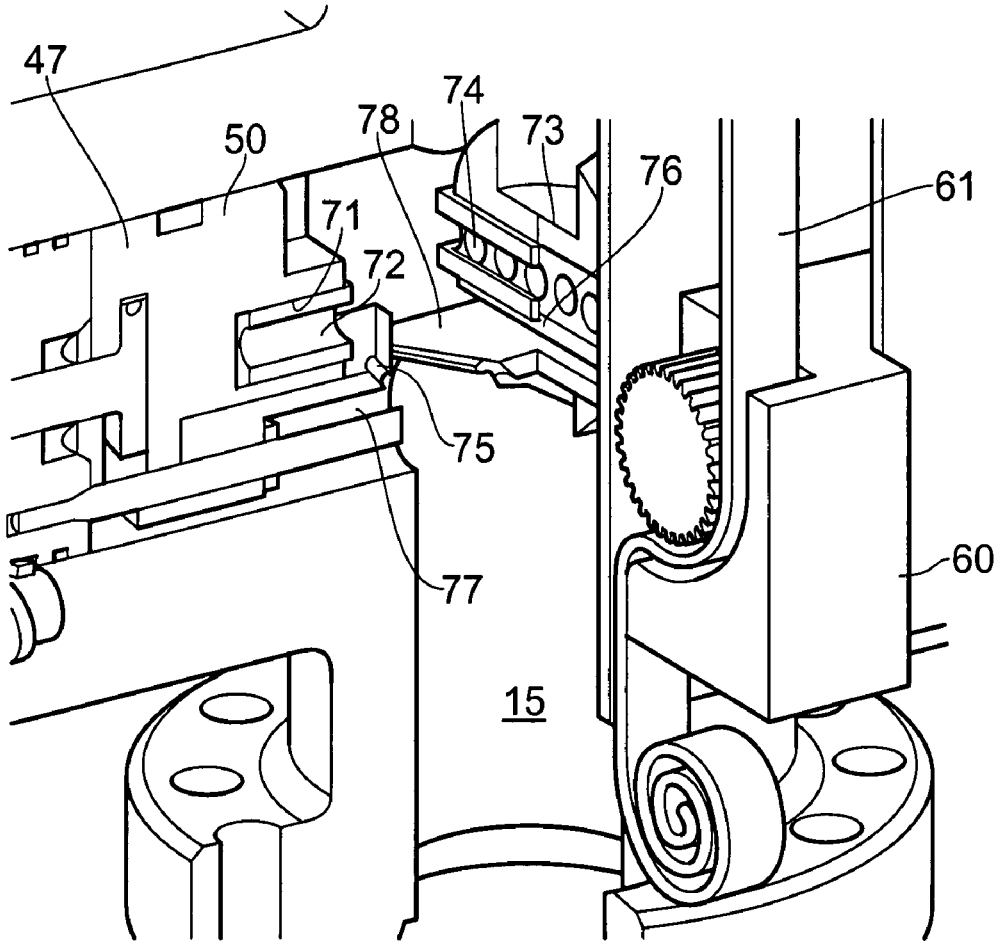

The invention will now be described in greater detail with reference to the attached drawings, in which:

FIG. 1 is a partial sectional view of a joint according to a first embodiment of the invention, FIG. 2 is a partial sectional view of a joint according to a second embodiment of the invention, FIG. 3 is a partial sectional view of a joint according to a third embodiment of the invention, FIG. 4 illustrates a detail of the mechanism in FIG. 1.

DETAILED DESCRIPTION OF THE INVENTION

FIG. 1 illustrates a joint 10 that forms a part of a pipe system. It may be in the form of an insert part with coupling ends 12, 14 for connecting to a riser, especially a working riser. The joint has an axis 16 that is aligned with the axis of the rest of the pipe.

The joint comprises an upper telescopic part 20 which defines a fluid channel 13 and has a flange 12 at one end. A lower telescopic part 40 defines a fluid channel 15 and has a flange 14 at one end. The lower part has a portion 17 with an extended diameter of the fluid channel 15 for receiving a pipe socket 22 that forms a part of the upper telescopic part. Sealing elements (not shown) are mounted between the lower part 40 and the pipe socket 22. The pipe socket 22 is releasably secured in the lower part 40 by means that are arranged to be broken or severed when subjected to a predetermined force. For example, the means may be in the form of shear pins 32, 34.

A floating piston is also advantageously provided for pressure balancing when the joint is broken, as described in more detail in our simultaneous application no. 20043933, filed on 10, Sep. 2004.

A bending limiter is also advantageously provided in order to reduce the stresses on the riser during normal use, which is well known in the art. It may, for example, be a rubber sleeve which is also described in greater detail in the above-mentioned previously filed application.

When the riser is subjected to tension exceeding a predetermined value, the shear pins 32 and 34 will break, thus enabling the upper part 20 to be separated from the lower part 40. The shear pins are arranged to be broken in the event of an upwardly directed tension.

In each of the upper and lower telescopic parts 20, 40, valves 21 and 41 respectively are mounted in the form of oppositely directed rams, which, when the pistons are moved towards each other, are arranged to close the passage 15. Since the valves are identical, only the lower valve 41 will be described in greater detail as it will be understood that the upper valve 21 contains corresponding parts. As illustrated in FIG. 1, the valve 41 may be machined in one piece with the telescopic part 40, with the result that it is in the form of two projecting valve housings 42, 44. Alternatively, the valve housings may be separate parts that are attached to the telescopic part 40 by means of bolts or the like. The valve housings 42, 44 are also identical and arranged symmetrically about the joint's centre axis 16. Thus the description of the parts in the valve housing 42 that follows will apply to corresponding parts in the valve housing 44.

The valve housing 42 has a through-going bore 43 whose axis 44A intersects the axis 16 of the main passage. The bore 43 is closed by an end plate 45 which, by means of bolts 46, is attached to the valve housing 42. The end plate 45 has a bore 48A which is of smaller diameter than, but axially aligned with the bore 43. A piston 47 with a front part 50 is movably mounted in the main bore 43. The piston is connected with an actuator rod 48. The actuator rod extends through the bore 48A in the end plate 45 and is attached to a crosshead 49. The crosshead 49 comprises two threaded bores 51, 52 for receiving driving rods 53, 54.

In FIG. 4 the valve's piston 47 is illustrated in greater detail. The front part 50 comprises a first bore 71 in which is mounted a seal 72. The opposite piston 73 has a corresponding seal 74, with the result that when the pistons are moved towards each other, the passage 15 is closed. Furthermore, in the front part 50 there is provided a knife 75 which is inserted in a slot 76 in the opposite piston 73. A slot 77 is also provided in the front part 50 for receiving a knife 78 in the opposite piston 73. The knives are used to sever an object located in the fluid channel 15 when the valves are closed.

Each driving rod 53, 54 extend from the crosshead 49 over to a crosshead 55 belonging to the second valve housing 44. The driving rod 53 has threaded ends 56, 57, with the result that one end has a right-hand thread while the other end has a left-hand thread. The driving rod 53 also comprises a cogwheel 58. A driving belt 59 has teeth over at least a part of its length and is passed over the cogwheel 58 so that the driving belt's teeth are engaged with the cogwheel's teeth. At its upper end the driving belt is attached to a securing device 30 on the upper telescopic part 20 while its lower end is loosened and rolled up as illustrated in FIG. 1.

As also illustrated in FIG. 1, three additional driving belts are provided whereof only two, 61 and 62 are illustrated. The driving belts 59 and 62 are attached in the upper telescopic part and mounted on each side of the joint. The driving belt 62 is connected with a cogwheel mounted on the driving rod 54 in the same way as that described for the driving rod 53.

The driving belt 61 and its non-illustrated corresponding belt on the opposite side are secured at their lower ends in the lower telescopic part 40 at 60 and, in the same way as for the valve 41, are mounted around corresponding cogwheels on driving rods 23 and 24 in the valve 21 in the upper telescopic part 20.

Alternatively, toothed racks may be used instead of belts.

When the joint is subjected to tension that causes the shear pins 32, 34 to break, the parts 20, 40 of the joints will begin to move apart. The driving belts that are fastened in the upper and lower telescopic parts will rotate the cogwheels, thereby causing the driving rods 53, 54 and 23, 24 to rotate and drive the crossheads inwards. Since the actuator rods are attached to the crossheads, the rams will be moved towards each other for closing the main passage 13, 15.

FIG. 2 illustrates a second embodiment of the invention, in which the safety jioint is indicated generally by reference number 100. The rams are designed in the same way as those in FIG. 1, but they are equipped with hydraulically operated actuators. Thus only the valves will be described in the following, since the other parts are identical to the joint illustrated in FIG. 1.

In the same way as described for FIG. 1, each valve 121, 141 comprises oppositely directed pistons which, when they are moved towards each other, are arranged to shut off the main passage 13, 15. In this embodiment the valves 121, 141 are also identical and in the following only the valve 141 will be described since it will be understood that the valve 121 is of identical design.

In the same way as illustrated in FIG. 1, the lower telescopic part 140 comprises valve housings 142, 144, which are also identical but inverted relative to each other. The valve housing 142 has a through-going bore 143 in which a piston 147 with a front end 150 is slidably mounted. The bore 143 extends to an actuator cylinder 145 which by means of, e.g. bolts 126 is attached to the valve housing 142. The cylinder 145 is closed at its other end by a cap 171 which has a bore 146A that is of smaller diameter than, but axially aligned with the bore 143. To the piston is attached an actuator rod 146 which in turn is attached to a hydraulic driving piston 149. A port 155 is provided in the valve housing 142. In a similar manner a port 151 is provided in the valve housing 144.

A rod 172 may be attached to the driving piston 149, extending through the bore 146A to the outside of the valve housing, thus enabling the piston 147 to be moved manually.

The joint 100 also comprises means to provide hydraulic power for operating the driving piston 149 and a corresponding driving piston in the valve housing 144. In the example illustrated in FIG. 2, the means comprise a number of piston and cylinder devices arranged symmetrically around the joint 100, whereof only two, 131, 133 are illustrated in FIG. 2. The device 131 has a piston 135 that is movable in a cylinder housing 136 of the device 131. A driving rod 137 extends from the piston 135 beyond the cylinder with its end attached to a flange 125 on the upper telescopic part 120. A port 138 is provided in the cylinder wall under the piston 135.

In a similar manner, the device 133 comprises a piston 165 with a driving rod 169 movable in a cylinder housing 166 with ports 167 and 168.

The port 138 is connected via a pipe 152 with the port 155 in the valve housing 142, while the port 167 is connected with the port 151 in the valve housing 144 via a pipe 154. Ports in the other non-illustrated cylinders are similarly connected with ports in the upper valve 121.

When the upper telescopic part 120 is pulled out of the lower telescopic part 140, the piston 135 in the piston device 131 will move upwards in the cylinder 136. This results in a negative pressure under the piston 135 and, via the pipe 152, a negative pressure in the actuator cylinder 145. This will cause the driving piston 149 and, thus, the ram 147 to move towards the joint's centre axis. The same process will occur with the second ram in the valve housing 144 and the valve will thereby close the passage 13, 15.

The same process will occur with the upper valve 121.

Alternatively, the driving fluid may be removed on the top of the piston 135 via a port 139 and passed to a port (not shown) on the back of the driving piston 149, thereby driving the ram 147 towards closing of the valve.

In an alternative version the cylinders may be arranged in the reverse manner, i.e. with the retaining flange located on the lower telescopic part 140. Alternatively, half of the piston devices may have oppositely directed piston rods, where half are attached to the flange 125 and half attached to the lower flange.

The rams are advantageously provided with cutting elements to enable them to sever a pipe located in the passage 15, as illustrated in FIG. 4.

The piston rod 137 is attached in such a manner that it will be broken when the telescopic parts are completely separated from each other. They may, for example, be provided with shear pins similar to those for the telescopic part 22 or any other type of weakening device.

FIG. 3 illustrates a third embodiment of the invention. A joint 200 is illustrated here where ball valves 221, 241 are mounted in the upper telescopic part 120 and the lower telescopic part 140 respectively. Each valve has a drive pin (not shown) connected to an arm 224 and 244 respectively. A driving rod 226 is attached at one end to the driving arm 224 and at its lower end is attached to the valve housing of the valve 241 at a fastening point 228. Similarly, a driving rod 246 is attached at one end to the driving arm 244 and at its other end is attached to the valve housing of the valve 221 at a fastening point 248. A combined stop and locking mechanism 230 and 250 respectively is provided in order to restrict the movement of the arms and to ensure that the valves are kept locked in their closed positions.

When the joint is subjected to tension that causes the shear pins to be broken, the parts will be pulled apart. The rods 226, 246 will thereby move the valve arms, thus causing the balls to rotate and the valves to close. At the fastening points 228, 248 the rods are provided with means that cause them to be released from the fastening points when the arms 224, 244 are rotated to their extreme position.

With the invention a solution has been arrived at where at least one fluid channel (13 or 15) in a riser can be closed if an event occurs that causes the joint to be broken. The valves will ensure that pressure in the riser is kept inside, thereby avoiding dangerous situations. If the event occurs while work is in progress in the well, a coiled tubing, wire or cable located inside the riser can also be severed.

Some embodiments for implementation of the invention have been described above, but for a person skilled in the art it will be obvious that several other methods exist for actuating the valves. For example, a key device may be employed which via a transmission mechanism pushes the rams towards each other. It will also be obvious to a skilled person that the hydraulic actuation can also be employed for the ball valves.

The joint may be placed at any suitable location, but advantageously near the seabed end and immediately above the emergency disconnect joint. Alternatively, the joint may be a part of the emergency disconnect unit, i.e. the lower part of the joint forms the emergency disconnect unit.

The invention claimed is:

1. A safety joint which comprises:

first and second telescoping parts, each of which comprises a corresponding fluid channel;

means for securing the first and second telescoping parts together, said means being arranged to be broken when a tension force exceeding a predetermined value is exerted between the first and second telescoping parts;

first and second valves, each of which is arranged in a corresponding one of the fluid channels; and actuating means responsive to the tension force for closing said first and second valves.

2. The safety joint of claim 1, wherein at least one of the first and second valves is a ball valve.

3. The safety joint of claim 1, wherein at least one of the first and second valves comprises a ram.

4. The safety joint of claim 3, wherein the ram comprises a cutting element.

5. The safety joint of claim 1, wherein the actuating means comprises means connected to the first telescoping part for operating a valve actuator on the second telescoping part.

6. The safety joint of claim 5, wherein the operating means comprises a mechanical transmission.

7. The safety joint of claim 6, wherein the mechanical transmission comprises a rod transmission.

8. The safety joint of claim 6, wherein the mechanical transmission comprises a pulling device.

9. The safety joint of claim 1, wherein the actuating means comprise at least one hydraulic piston.

10. The safety joint of claim 5, wherein the operating means comprise a hydraulic piston.

11. A safety joint which comprises:

a first part which comprises a first fluid channel;

a second part which comprises a second fluid channel and a pipe member that is slidably received in the first part;

means for securing the first and second parts together, said means being arranged to be broken when a tension force exceeding a predetermined value is exerted between the first and second parts;

a first valve positioned in the first channel;

a second valve positioned in the second channel;

a first actuating member which is connected between the first part and the second valve; and a second actuating member which is connected between the second part and the first valve;

wherein when the first and second parts are separated by a tension force exceeding the predetermined value, the first and second actuating members will close the first and second valves; and wherein the first and second actuating members operate independently of each other.

12. The safety joint of claim 11, wherein the first actuating member comprises a first drive belt having a first end which is connected to the first part and a second end which engages a cog wheel that is mechanically linked to an actuator rod for the second valve.

13. The safety joint of claim 12, wherein the second actuating member comprises a second drive belt having a first end which is connected to the second part and a second end which engages a cog wheel that is mechanically linked to an actuator rod for the first valve.

14. A safety joint which comprises:

a first part which comprises a first fluid channel;

a second part which comprises a second fluid channel and a pipe member that is slidably received in the first Part:

means for securing the first and second parts together, said means being arranged to be broken when a tension force exceeding a predetermined value is exerted between the first and second parts;

a first valve positioned in the first channel;

a second valve positioned in the second channel;

a first actuating member which is connected between the first part and the second valve; and a second actuating member which is connected between the second part and the first valve;

wherein when the first and second parts are separated by a tension force exceeding the predetermined value, the first and second actuating members will close the first and second valves; and wherein the first actuating member comprises a first piston which is connected to the first part and a fluid conduit for conveying hydraulic pressure developed by the first piston to a hydraulic driving piston which is connected to an actuator rod for the second valve.

15. The safety joint of claim 14, wherein the second actuating member comprises a second piston which is connected to the second part and a fluid conduit for conveying hydraulic pressure developed by the second piston to a hydraulic driving piston which is connected to an actuator rod for the first valve.

16. The safety valve of claim 11, wherein the first actuating member comprises a first driving rod having a first end which Is connected to the first part and a second end which is connected to an arm that in turn is connected to a drive pin for the second valve.

17. The safety valve of claim 16, wherein the second actuating member comprises a second driving rod having a first end which is connected to the second part and a second end which is connected to an arm that in turn is connected to a drive pin for the first valve.

* * * * *